United States Patent [19]

Tajima

[11] Patent Number: 4,584,804

[45] Date of Patent: Apr. 29, 1986

[54] MECHANISM FOR JOINING A MULLION TO A TRANSOM IN A CURTAIN WALL

[75] Inventor: Kazuo Tajima, Tokyo, Japan

[73] Assignee: Tajima Junzo Seisakusho, Ltd., Tokyo, Japan

[21] Appl. No.: 484,672

[22] Filed: Apr. 13, 1983

[30] Foreign Application Priority Data

Apr. 14, 1982 [JP] Japan ..... 57-64141

[51] Int. Cl.[4] ..... E04H 1/00; E04H 3/00; E06B 7/14

[52] U.S. Cl. ..... 52/235; 52/209; 52/303; 52/668

[58] Field of Search ..... 52/235, 669, 668, 209, 52/303

[56] References Cited

U.S. PATENT DOCUMENTS

| | | | |
|---|---|---|---|
| 2,914,145 | 11/1959 | Benson | 52/303 |
| 2,949,981 | 8/1960 | Ferrell | 52/303 |
| 3,147,518 | 9/1964 | Horgan, Jr. | 52/235 |
| 3,221,453 | 12/1965 | Lietaert | 52/235 |
| 3,266,210 | 8/1966 | Grossman | 52/235 |
| 3,321,880 | 5/1967 | Ferrell et al. | 52/235 |
| 3,357,145 | 12/1967 | Grossman | 52/235 |
| 3,548,558 | 12/1970 | Grossman | 52/235 |
| 3,734,550 | 5/1973 | Vance | 52/303 |
| 3,844,087 | 10/1974 | Schultz et al. | 52/209 |
| 3,852,148 | 12/1974 | Pryor et al. | 52/303 |
| 4,060,950 | 12/1977 | Rackard et al. | 52/668 |
| 4,103,598 | 8/1978 | Cooper | 52/303 |

*Primary Examiner*—Donald G. Kelly
*Assistant Examiner*—Michael Safavi
*Attorney, Agent, or Firm*—Sughrue, Mion, Zinn, Macpeak, and Seas

[57] ABSTRACT

A joiner for joining mullions to transoms in a curtain wall includes a U-shaped gasket receiving an outer transom surface and a table for slidably supporting an extended end of the transom. A slider element abuts the transom end to prevent outward movement thereof.

6 Claims, 4 Drawing Figures

MECHANISM FOR JOINING A MULLION TO A TRANSOM IN A CURTAIN WALL

BACKGROUND OF THE INVENTION

The present invention relates to a mechanism for joining mullions to transoms in a curtain wall.

The primary purpose of the present invention is to provide a mechanism that enables simple on-site joining of mullions and transoms which are factory-fabricated as members of a curtain wall. This mechanism prevents water leakage from the joint between the mullion and transom. At the same time, it is capable of adjusting well to a lateral displacement between the mullion and transom, as well as to the thermal expansion and contraction of the transom.

The use of a pressure equalization system in a mullion type curtain wall has been gaining wider acceptance recently. According to this system, a space having a pressure almost equal to that of the atmosphere is created in both mullions and transoms, and the wind pressure of an incoming rain storm is eliminated in this space, and the rain water is drained by gravity, whereas the entrance of rain water into the building is prevented by a rain barrier provided between the pressure-equalized space and the inside of the building. Since the rain barrier is not provided on the outer surface of the curtain wall, this balanced pressure system claims significantly increased durability of the airproofing sealants (i.e. gaskets and caulking components) provided in the junctions of the rain barrier and protected from the elements. However, in a mullion type curtain wall, the airproofing sealants on the rain barrier consist of an internal sealant around a glass pane encased in the mullion and transom and a joint sealant laid along the joint between the mullion and transom, and gaskets and caulking compounds are carefully applied to the necessary sealing portions on site. Particularly, great care is needed in providing the joint between the mullion and transom with a hermetic seal that not only prevents water leakage but also adjusts well to lateral displacement between the two members and to the thermal expansion and contraction of the transom.

In the conventional method of assembling a curtain wall, a prefabricated mullion with an angular mounting member is shipped to the site, where an end of a transom is bolted to the mounting member. But this procedure, in addition to the installation of a hermetic seal in the joint between the mullion and transom, greatly increases the complexity of constructing the curtain wall.

These defects in the conventional technique for joining the mullion to a transom in a curtain wall construction are eliminated by the new joint mechanism of the present invention, described hereunder.

DETAILED DESCRIPTION OF THE PREFERRED EMBODIMENTS

Figure 1:
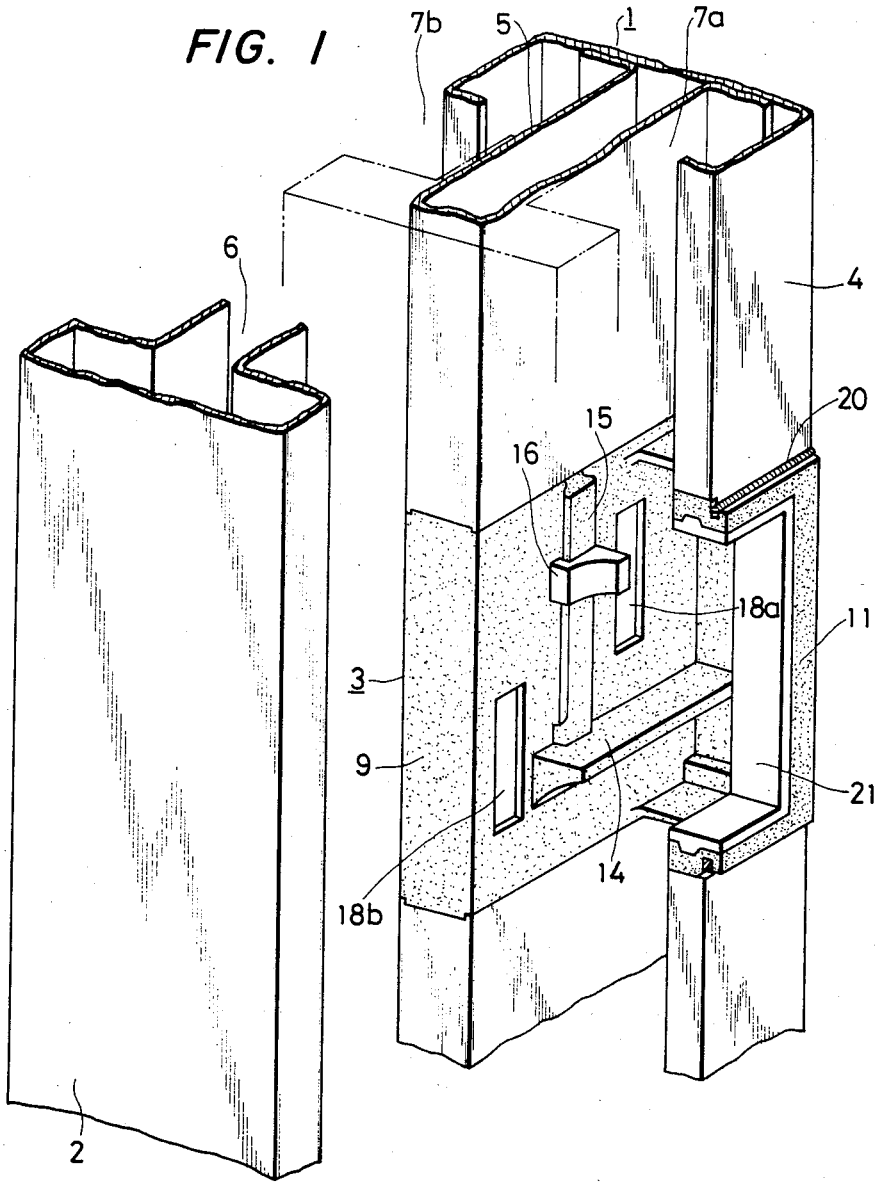
FIGS. 1 to 4 are each a perspective view illustrating one embodiment of the present invention.
Figure 2:
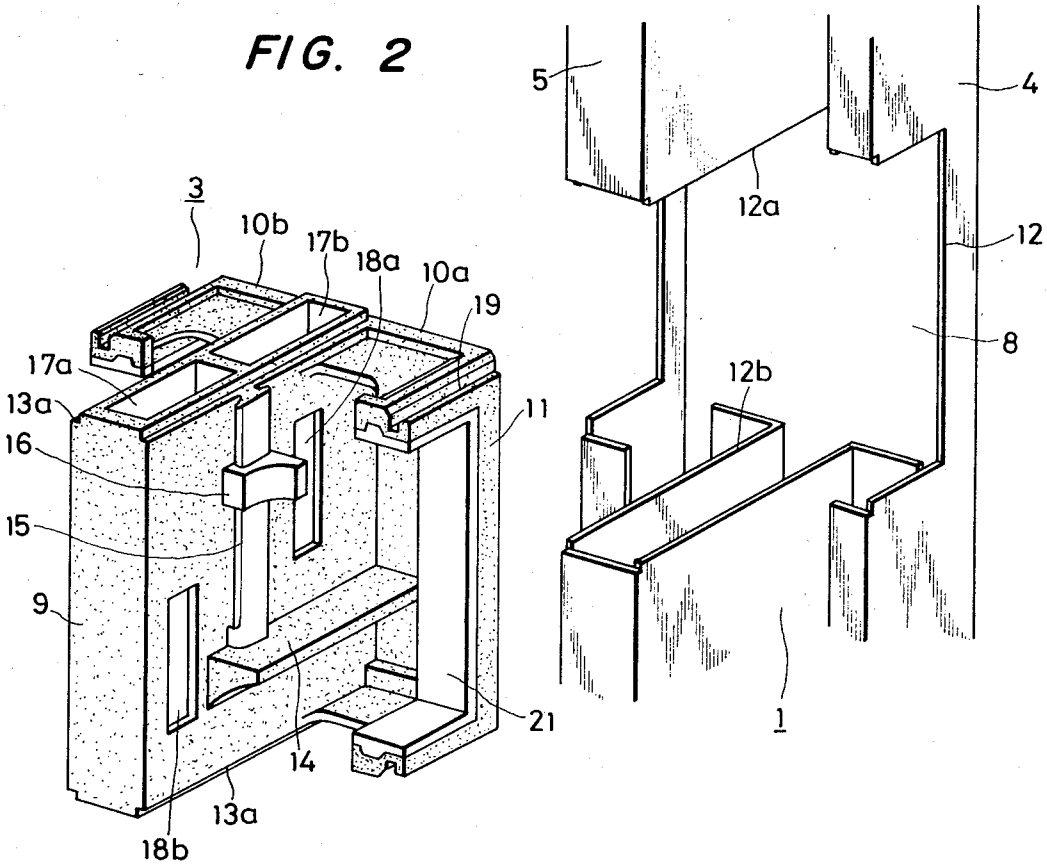

In FIGS. 1 to 4, reference numeral 1 indicates a mullion, 2 is a mullion cover, and 3 is a joiner. Mullion 1 is made integral with a reinforcing member (not shown) and is supported on the structural members of the building with fasteners. Mullion 1 is made of a generally T-shaped metal sheet such as stainless steel, and is composed of a channel-shaped inner mullion 4 spot-welded to a hat-shaped partition member 5. Mullion cover 2 has an opening 6 along its length, into which partition member 5 is inserted to define, on both sides, grooves 7*a* and 7*b* into which panes of glass are to be fitted. That part of mullion 1 which is to be crossed by a transom is cut away as shown on the right in FIG. 2, and the joiner 3 is fitted in the resulting notch 8 and factory-welded to mullion 1. Joiner 3 comprises a center column 9, arms 10*a* and 10*b* (since the two arms are symmetrical in shape, the following description concerns only arm 10*a*) and a transom retainer 11, these elements usually being cast from stainless steel as a unit by the lost wax process. Center column 9 has, at its upper and lower ends, stepped portions 13*a* and 13*b* that bear against the rectangular cross section defined by notched butt ends 12*a* and 12*b* of partition member 5. Center column 9 also has a transom table 14 and a ridge 15 along which a slider 16 moves vertically. Center column 9 has two through channels 17*a* and 17*b* that communicate with the air inlet duct provided by partition member 5, and openings 18*a* and 18*b* for introducing atmospheric air into the pressure-equalized space through said channels.

Transom retainer 11 connected to center column 9 by arm 10*a* is partially surrounded by a groove 19 into which the edge of the notched portion of inner mullion 4 is fitted. A gap is left on the side of the groove far from, rather than near to, the center column 9, which is large enough to be filled with a caulking compound 20. Therefore, the caulking operation can be performed off site to provide a hermetic seal between inner mullion 4 and transom retainer 11, and the mullion 1 having the joiner 3 as an integral part can be shipped to the construction site.

Figure 3:
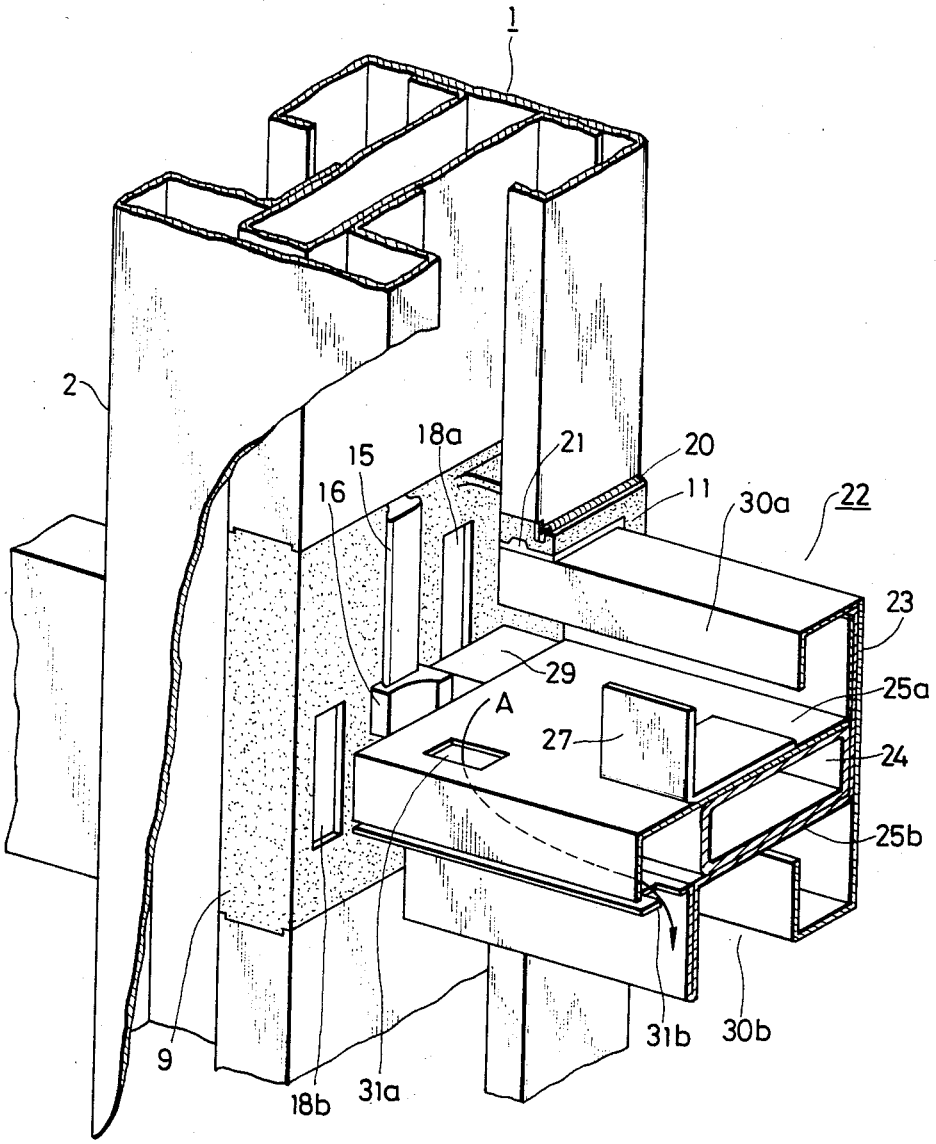
Figure 4:
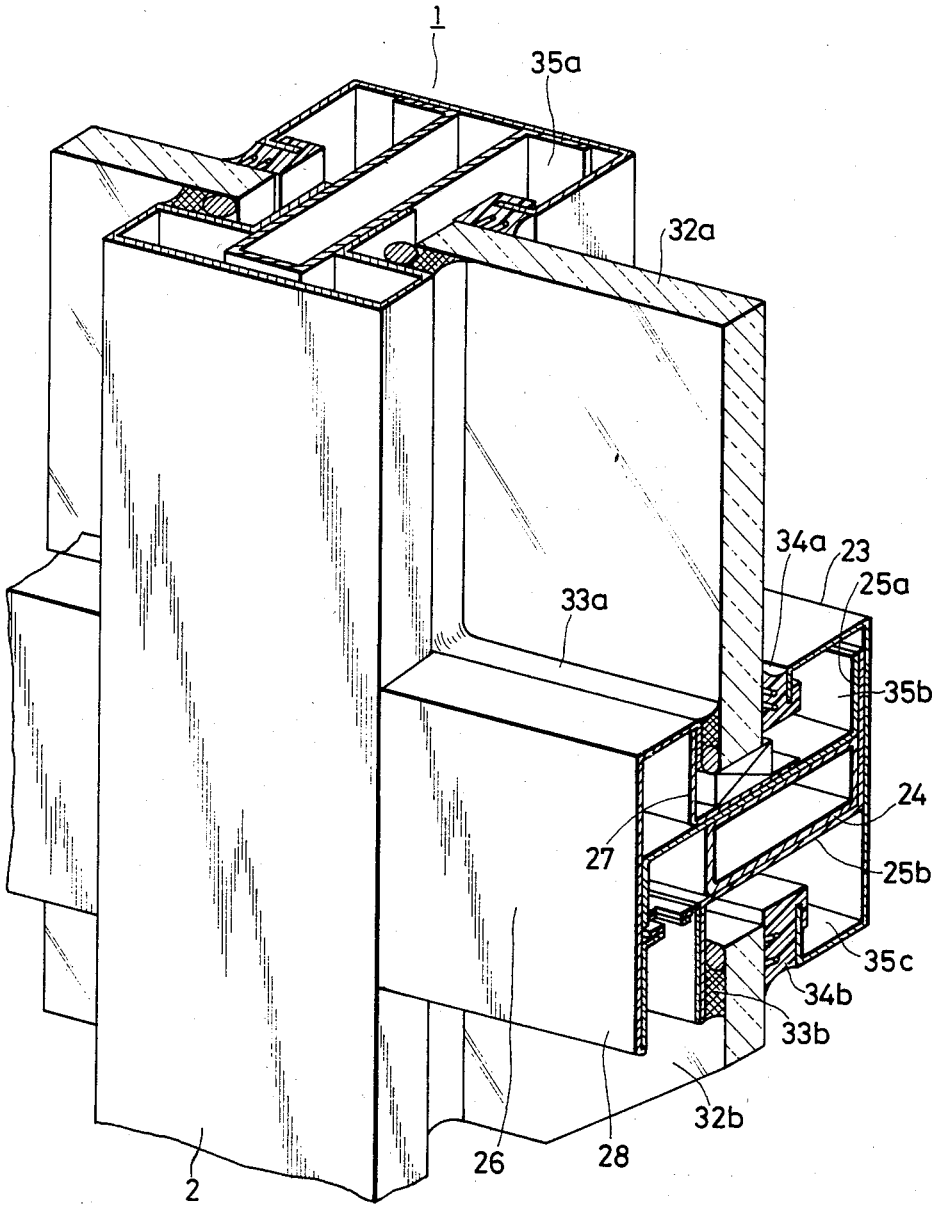

The inner surface of retainer 11 is generally U-shaped and is equipped with a strip of gasket 21 for providing a hermetic seal. This gasket combines with retainer 11 to hold in position the end of transom 22 facing the interior of the building as shown in FIG. 3. Since gasket 21 is elastic, transom 22 can be fitted into the retainer 11 on site. As shown in FIGS. 3 and 4, transom 22 is made of an inner wall member 23, hollow core 24, upper and lower connectors 25*a* and 25*b*, and a detachable back bend 26. The upper end of back bend 26 is connected to a tab 27 mounted on connector 25*a*, and is bent down to form a water drip 28 which is bolted to lower connector 25*b*. Hollow core 24 is secured to inner wall member 23 and connectors 25*a* and 25*b* by suitable means such as spot welding. Engaging end portion 29 of the core 24 is placed on the transom table 14 extending from center column 9, whereas the lateral side of the core engages slider 16.

The above procedure completes the joining of mullion 1 to transom 22. As a result, the outer periphery of wall member 23 of transom 22 is retained by gasket 21 on retainer 11, which is made integral with mullion 1, and the transom is restrained from moving vertically or toward the inside of the building. At the same time, the engagement with slider 16 prevents transom 22 from moving toward the outside of the building. Transom 22 is positioned such that engaging portion 29 is spaced from center column 9 by a small clearance, so if transom 22 expands or contracts with heat, the engaging portion 29 can slide horizontally on table 14. This movement is also permitted by the elastic gasket 21 formed on the inner surface of transom retainer 11.

In FIG. 3, 30*a* and 30*b* are grooves in which panes of glass are set, and 31*a* and 31*b* are weep holes through which entrant rain water can be drained from transom 22 in the direction indicated by arrow A.

FIG. 4 shows the completed curtain wall installation with glass panes 32*a* and 32*b* set in position. The gap between the exterior surface of glass pane 32*a* and mullion cover 2/tab 27 is filled with a caulking compound 33*a*, and the gap around the exterior surface of glass 32*b* is likewise filled with a caulking compound 33*b*. The gap between the interior surface of glass 32*a* and inner transom wall 23 is provided with a gasket 34*a*, and the gap around the interior surface of glass 32*b* is likewise provided with a gasket 34*b*. In this type of curtain wall, gaskets 34*a* and 34*b* provided around the interior surface of the glass panes function as hermetic seals for the rain barrier, and gasket 21 forming the inner surface of transom retainer 11 serves as a hermetic seal for the joint between mullion 1 and transom 22. Therefore, by setting glass panes 32*a* and 32*b* in place, spaces 35*a*, 35*b*, 35*c*, etc. having a pressure equal to the atmospheric pressure are formed within the mullion and transom. The atmosphere outside the building is introduced into these spaces through the seams along the mullion cover 2, and these spaces communicate with each other by way of channels 18*a* and 18*b* passing through center column 9.

In summary, the present invention provides a mechanism for joining a mullion 1 to a transom 22 in a curtain wall, wherein the mullion is made integral with a joiner 3 fitted in a notch 8 made in that part of the mullion to which the transom is to be connected, the joiner holding the transom in position with a gasket 21 in order to restrain the transom from moving vertically and toward the inside of the building, with the end 29 of the transom engaging a slider 16 on the joiner that restrains it from moving toward the outside of the building. This mechanism has the following advantages: (1) the provision of a hermetic seal along the interior junction between the mullion and transom by conventional techniques has been very complicated and without high reliability, but the joining mechanism of the present invention establishes the desired hermetic and waterproof seal by gaskets that can be readily installed at the factory (2) any lateral displacement of the transom can be absorbed by the strip of gasket forming the interior surface of the transom retainer; and (3) the joint adjusts well to the thermal expansion and contraction of the transom because one end of the transom is capable of sliding on the table of the joiner only in the longitudinal direction of the transom. But more importantly, the transom retainer of the joiner is surrounded by a groove that completely accommodates the edge of the notched portion of the mullion, and this provides a joint between the mullion and transom. Furthermore, the present invention obviates the need of a bolt for joining the mullions to the transoms at the construction site; instead, the invention can be used in the construction of a curtain wall by a simple method that comprises retaining the transom on gaskets primarily used for providing airtightness and providing a slider in engagement with one end of the transom.

What is claimed is:

1. A mechanism for joining a mullion to a transom in a curtain wall construction of a building, comprising:
   - an inner mullion having at least one notch;
   - a joiner fitted in said notch, said joiner having a plurality of air passageways in a central portion thereof, and a pair of symmetrically arranged arms, each of said arms having a U-shaped transom receiving portion;
   - a slider, movable along a vertical bar on said joiner to a first position for receiving a transom and to a second position for restraining said transom, thereby preventing movement of said transom toward an outer side of the building;
   - a table, connected to said joiner, for receiving and permitting horizontal thermal expansion of said transom, said air passageways being positioned on either side of said transom; and
   - airproofing sealant, fitted into said transom receiving portion of each of said arms.

2. A mechanism as claimed in claim 1, wherein said transom receiving portion includes a surface in contact with said mullion and a free lip about the exterior of said mullion for receiving a sealant.

3. A mechanism as claimed in claim 1, said table receiving an extended end portion of said transom, said slider engaging said extended end portion.

4. A mechanism as claimed in claim 1, said joiner including at least one central cavity, said air passageways joining said cavity with air spaces in said transom.

5. A mechanism as claimed in claim 3, said transom being slidably disposed on said table.

6. A mechanism as claimed in claim 1, said airproofing sealant comprising a gasket tightly fitted in said transom receiving portion.

* * * * *